United States Patent [19]

D'Agosta

[11] Patent Number: 4,708,340

[45] Date of Patent: Nov. 24, 1987

[54] EXERCISE AND SPORTING DEVICE

[76] Inventor: Nino D'Agosta, 1316 Hickory St., Omaha, Nebr. 68108

[21] Appl. No.: 360,442

[22] Filed: Mar. 22, 1982

[51] Int. Cl.[4] ..... A63B 13/00

[52] U.S. Cl. ..... 272/117

[58] Field of Search ..... 272/67, 117, 123, 124, 272/62, 63, 93, 113; 248/165, 440, 176; 135/100, DIG. 9

[56] References Cited

U.S. PATENT DOCUMENTS

| | | | |
|---|---|---|---|
| 3,094,324 | 6/1963 | Shingleton | 272/117 X |
| 3,414,260 | 12/1968 | Gust | 272/124 |
| 3,690,655 | 9/1972 | Chapman | 272/117 X |
| 3,704,849 | 12/1972 | Green | 272/62 X |

FOREIGN PATENT DOCUMENTS

| | | | |
|---|---|---|---|
| 1363572 | 8/1974 | United Kingdom | 248/165 |

OTHER PUBLICATIONS

"Strength and Health"; Feb.-Mar. 1975; pp. 28 and 57.

*Primary Examiner*—Richard J. Apley
*Assistant Examiner*—S. R. Crow
*Attorney, Agent, or Firm*—Zarley, McKee, Thomte, Voorhees & Sease

[57] ABSTRACT

An exercise device for strengthening one's grip, wrists, arms and back is disclosed. The device includes a frame having three elongate members that are joined in a point at the top with an elongate extension projecting upwardly up from the apex. The upward elongate extension provides a situs for removably attaching weights. The device is used by sitting it on a flat surface, gripping one of the elongate members near the lower terminus of that member and rotating the device about a fulcrum created by the intersection of the flat surface and two lower terminus points of the two of the elongate members, one of which is the grip member.

4 Claims, 9 Drawing Figures

EXERCISE AND SPORTING DEVICE

BACKGROUND OF THE INVENTION

This invention relates generally to an exercise device and particularly to weight training and sporting devices to improve one's grip, wrists, arms and back.

The use of weight training devices has long been established as beneficial in improving one's strength and muscle development. Competition between users of weight training equipment is frequent and tests of strength and endurance are shown throughout recorded history. Recently, for example, the sport of arm wrestling has enjoyed a resurgence in popularity.

Most weight devices rely upon the gravitational attraction of the weights working against the user's muscles to place stress on that particular muscle group. Since the gravitational pull on earth is fairly constant worldwide, it is possible for a comparison to be made between competitors using similar weights (mass). For example, two people at different locations, both lifting one hundred pound weights, can compare their relative strengths against one another. Such constancy allows for competition in weight training and provides a source of entertainment in the testing of one's skill and strength.

Of all of the weight training devices presently known, most rely upon either the actual lifting of the weight or lifting the weight with the guidance of pulleys, cables, or other means to ensure uniformity in strictness of movement. In some cases, to accurately compare exercises and thereby compare strength, it is necessary for certain rules to be established with respect to how the excercises are conducted. For example, when one wishes to curl a bar having weights attached to test the strength of one's biceps, it is possible to eliminate additional assistance from other muscle groups by requiring that the participant place his back against the wall before performing the curl exercise.

Although many exercises have been developed for lifting weights, there are few actual devices which allow for developing specific groups of muscles. The instant invention is directed toward a device which helps to develop the strength in one's hands, wrists as well as muscles in one's arm and back. The device allows for a number of different exercises as well as a particular competitive form of utilizing the device. The device also strengthens the muscles used in golf, tennis, racketball and other sports. A particularly important aspect of the device is that it is a new sport itself, and new methods of competing have been developed and disclosed herein. The sport is called GWRAB, as it utilized the grip (G), wrist (Wr), arms (A) and back (B).

As exercise devices become more complex, thereby expensive, there exists a need for a simple device that allows for weight training and competition and the development of strength in specific muscle groups. The instant invention is directed toward that need.

SUMMARY OF THE INVENTION

It is an object of the instant invention to provide an improved weight training device which allows one to develop the strength in the grip, wrist, arms and back.

It is another object of the instant invention to provide a weight training device having a plurality of elongate members joined at an apex and providing a situs for the attachment of weights.

It is another object of the instant invention to provide a device which can be used with removably attached weights thereby adjusting the resisting force utilized in developing one's strength.

It is another object of the invention to provide a device for use in competition between individuals as well as teams.

It is a feature of the invention to provide such a device which is lightweight, portable and easy to use on any substantially flat surface.

It is a still further object of the instant invention to provide a weight supporting frame means having a fulcrum for pivoting the weight from the vertical to the horizontal and from the horizontal to the vertical.

It is yet still a further object of the invention to provide a device which can be used to improve one's performance in golf, tennis, racketball and other sports.

These and other objects and features are attained according to the instant invention by providing a novel exercise and competition device having three elongate members joined at an apex which further provides an elongate extension for removably attaching weights.

BRIEF DESCRIPTION OF THE DRAWINGS

The advantages of this invention will become apparent upon consideration of the following detailed disclosure of the invention, especially when taken in conjunction with the accmpanying drawings wherein.

DESCRIPTION OF THE PREFERRED EMBODIMENTS

Figure 1:
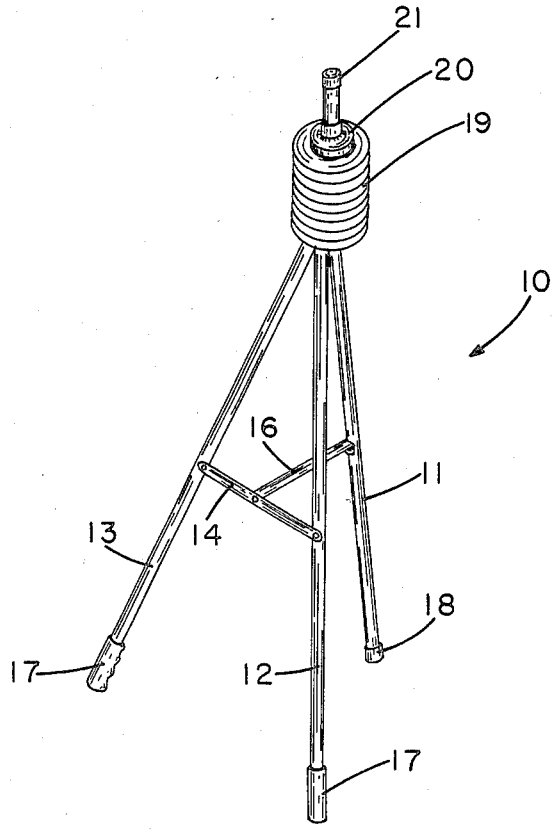
FIG. 1 is a perspective view of the device.

The apparatus and method to be discussed in detail below are unique in both the construction and use. As can be seen in FIG. 1, the exercise device 10 is generally comprised of elongate members 11, 12 and 13 which are joined together at an apex which is provided with elongate extension 21. Weights 19 are placed on elongate extension 21 and a weight collar 20 is installed to prevent the weights 19 from slipping off of the elongate extension 21. Stiffening members comprised of brackets 14 and 16 are attached between elongate members 11, 12 and 13 to provide structural integrity. Hand grips 17 are placed on the lower end of elongate members 12 and 13 to provide a gripping surface and protective cup 18 is placed on the lower end of elongate member 11.

Figure 2:
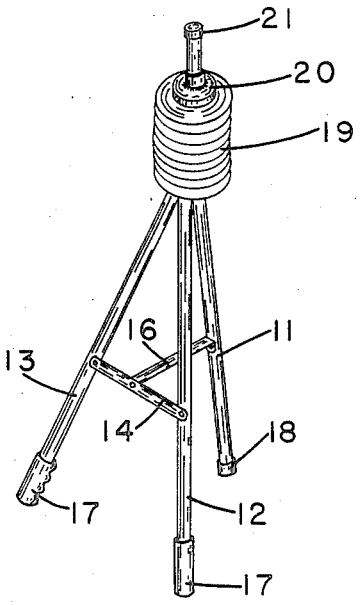
FIG. 2 is a perspective view of a second embodiment of the device in which the elongate supporting members are shorter in length than in the embodiment shown in FIG. 1.

In FIG. 2, the identical components are shown although it will be noted that elongate members 11, 12 and 13 are shortened and stiffening members 14 and 16 are in a slightly different position with respect to elongate members 11, 12 and 13.

FIG. 1 depicts the larger model which it is contemplated would be used for adults, primarily men, whereas the smaller model as depicted in FIG. 2 would be utilized by children and women and possibly men who could not utilize the larger model, due to limitations in their strength.

Figure 9:
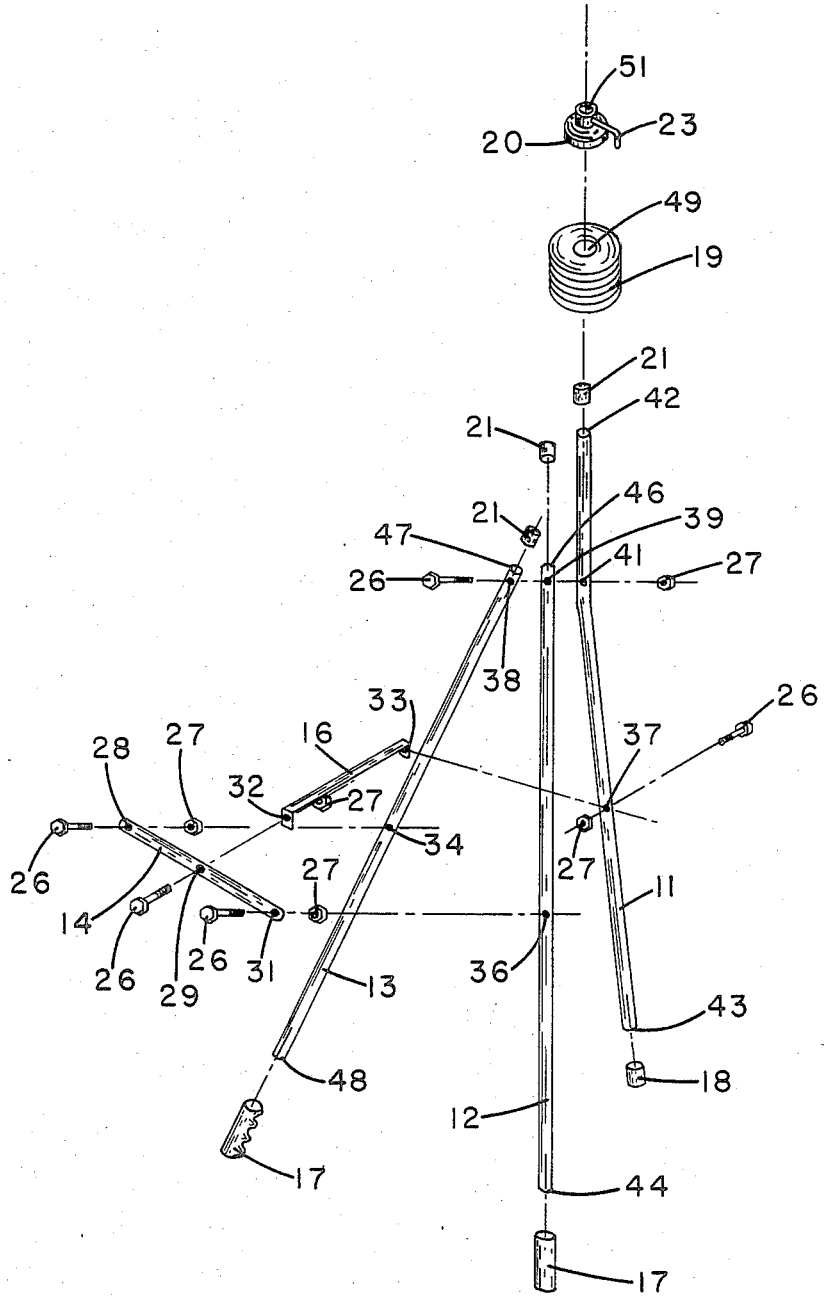
FIG. 9 is an exploded perspective view of the device depicting the component parts thereof.

In FIG. 9 all of the component parts of the device 10 can be shown in greater detail. As shown in FIG. 9, elongate member 12 is a hollow tube or rod, such as an electrical conduit which has an upper end 46 and lower end 44. Elongate member 12 optimally is between two and four feet long and it has been found in the preferred embodiment that it is approximately three feet long. Hole 36 is provided in elongate member 12 at a point between upper end 46 and lower end 44. Elongate member 13 is identical to elongate member 12 in that it is provided with an upper end 47 and a lower end 48 and hole 34. Elongate member 11 is made of the same material as members 12 and 13 and is provided with upper end 42 and lower end 43, however, it has been found for ease of instruction that elongate member 11 is slightly longer than elongate members 13 and 12 and can be bent so that upper end 42 projects substantially normal to the base surface when members 11, 12 and 13 are joined at an apex. Holes 41, 39 and 38 are drilled in elongate members 11, 12 and 13 respectively to provide for joining of elongate members 11, 12 and 13 by use of bolt 26 and nut 27. The distance from that point of attachment to the lower terminus end 43, 44 and 48 is nearly identical. Thus, the distance between lower end 43 on elongate member 11 and hole 41 would be the same as the distance between lower end 44 of elongate member 12 and hole 39 and so on. Upper ends 47, 46 and 42 in elongate members 13 12 and 11 respectively are provided with caps 21 which are cylindrical in shape having an upper portion which seals off the opening in elongate members 11, 12 and 13. The lower ends of elongate members 11, 12 and 13 are also provided with caps in which the lower end 43 of elongate member 11 is provided with cap 18 which is similar in construction and utilization as cap 21. The lower ends 44 and 48 of members 12 and 13 are each provided with a hand grip cap 17 which provides a gripping surface for the use of the device 10. Weights 19 which are a number of flat disc type washers having a hole 49 can be placed upon upper extension 42 of elongate member 11, as can weight collar 20 having center hole 51 and tightening screw 23.

Bracket 14 is an elongate member having holes 28, 29 and 31 in which bolts 26 are inserted to co-act with holes 34 and 36 in members 13 and 12 and hole 32 in bracket no. 16. Nuts 27 are utilized on bolts 26 to securely fasten bracket 14 to elongate members 12, 13 and 16. Bracket 16 is provided with holes 32 and 33 in which bolts 26 can be inserted to attach bracket 16 through hole 37 in elongate member 11 and through hole 29 in bracket 14.

Figure 3:
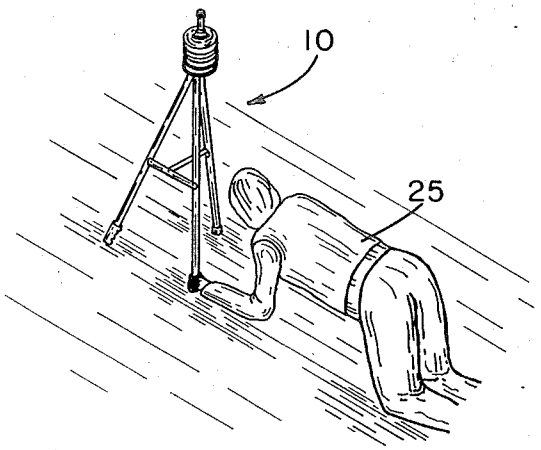
FIG. 3 is a perspective view of the device setting on a flat surface and a user using the device by gripping it at one end.
Figure 4:
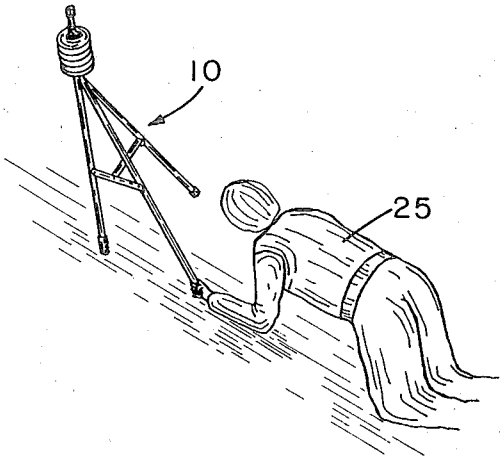
FIG. 4 is a perspective view of the device in use showing the user pivoting the device about a fulcrum created by the ends of two of the elongate members.
Figure 5:
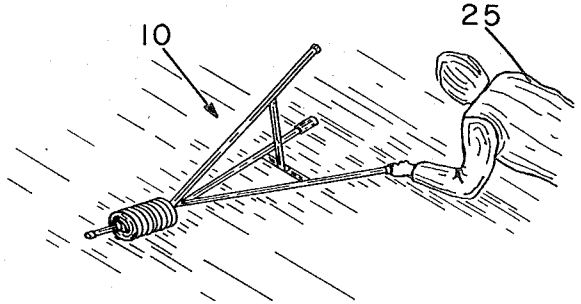
FIG. 5 is a perspective view of the device showing the user having pivoted the device to the horizontal position.

The use of the device 10 will now be described. In the two major exercises for competitions utilizing the device 10, the first is depicted in FIGS. 3, 4 and 5. In this exercise the user 25 grips the device 10 at the lower end and rotates the device 10 from the vertical to the horizontal while the rotation of the device 10 on the flat surface is colinear with the user's forearm. As the device 10 is moved from the vertical to the horizontal, the pull of the weights 19 become greater and more strength is required in order to keep the device 10 from totally reaching the horizontal. When the device 10 has reached the horizontal or so near that the weights 19 are nearly touching the flat surface, then the user 25 reverses the position and returns the device 10 from the horizontal to the vertical. As greater amounts of weights 19 are placed on the device 10, the exercise becomes more difficult.

Figure 6:
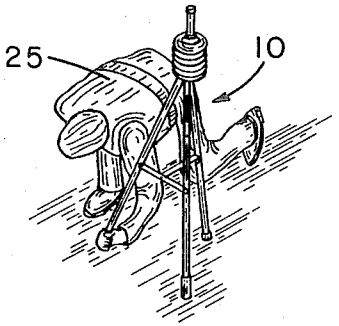
FIG. 6 is a perspective view of the user depicting yet another exercise with the device in which the user is gripping the device in a vertical position.
Figure 7:
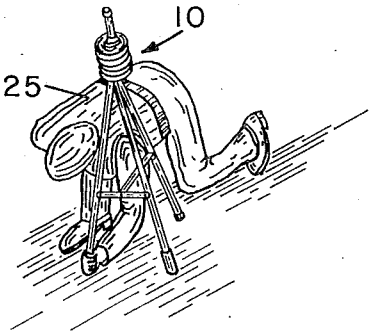
FIG. 7 is a perspective view of the device in use in which the device is partially pivoted from the vertical to the horizontal position.
Figure 8:
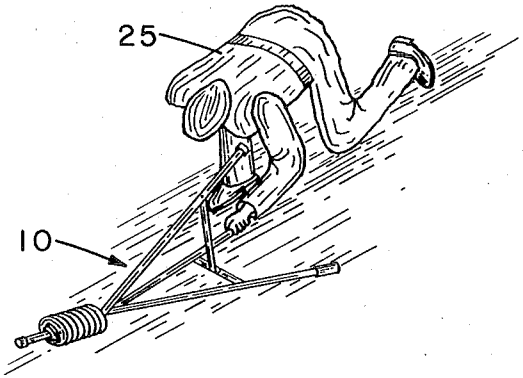
FIG. 8 is a perspective view of the device in which the user has pivoted the device from the vertical to the horizontal position.

FIGS. 6, 7 and 8 show the second major exercise for competition in which the user 25 grips the device 10 and rotates it about a fulcrum substantially normal to the longitudinal axis of the user's forearm. The user 25 rotates the device 10 from the vertical to the horizontal and then back to the vertical in a similar manner as is depicted in FIGS. 3, 4 and 5.

A totally new sport is thus described in which individuals and teams compete against time, themselves, each other, and in all cases, against gravity.

It is contemplated that signalling devices (not shown) could be located so that they are activated by the device 10 or by the weights 19 as the device 10 comes within a close distance to the flat surface. In this manner, the length of time of raising the device 10 from the horizontal to the vertical could be measured, thereby allowing for a timed competition.

Although specific components, proportions and process steps have been stated in the above description of the preferred embodiments of the invention, other suitable materials, proportions and process steps as listed herein may be used with satisfactory results and varying degrees of quality. In addition, it will be understood that various other changes in the details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. An exercise device for strengthening one's grip, wrist, arms and back, comprising, a frame means including first, second and third elongate members each having upper and lower ends, said three elongate members being joined together adjacent the upper ends thereof, said lower ends extending outwardly and downwardly from said joined upper ends, and terminating in three support points, a weight attachment means comprising a bent end portion at the upper end of said first elongate member, said bent end portion extending upwardly in upright relation from said joined upper ends, said second and third elongate members being of equal length, which length is between two and four feet, a plurality of brace means interconnecting said three elongate members, said brace means being positioned intermediate the opposite ends of said elongate members, a plurality of removable disc weights having center openings therein, said discs being supported in stacked relation on said joined upper ends of said second and third elongate members with said bent end portion extended through said center openings, and a removable weight securement means fastened to said bent end portion above said disc weights to retain said weights thereon, said disc weights being removably positioned on said bent end portion to thereby accommodate incremental weight variations for a generally 90° pivotal movement of the device about an axis extended between the support points or two elongate members by various users having only a single handed grip on one of said two elongate members adjacent the support point thereof.

2. The device as described in claim 1 further comprising hand grip means attached to said lower ends of at least one of said elongate members.

3. The device as described in claim 1 wherein said weight attachment means is comprised of an annular collar.

4. The exercise device of claim 1 wherein said brace means comprises a first brace connected to and extended between two of said elongate members and a second brace connected to and extended between the other elongate member and the center of said first brace.

* * * * *